US006325709B1

(12) United States Patent
Nanda et al.

(10) Patent No.: US 6,325,709 B1
(45) Date of Patent: Dec. 4, 2001

(54) ROUNDED SURFACE FOR THE PAD CONDITIONER USING HIGH TEMPERATURE BRAZING

(75) Inventors: Arun Kumar Nanda; Ser Wee Quek, both of Singapore (SG)

(73) Assignees: Chartered Semiconductor Manufacturing Ltd, Singapore (SG); Lucent Technologies, Inc., Allentown, PA (US)

( * ) Notice: Subject to any disclaimer, the term of this patent is extended or adjusted under 35 U.S.C. 154(b) by 0 days.

(21) Appl. No.: 09/442,495

(22) Filed: Nov. 18, 1999

(51) Int. Cl.[7] ..... B24B 21/18

(52) U.S. Cl. ..... 451/443; 451/41; 451/56; 451/287; 451/288; 451/443; 451/444

(58) Field of Search ..... 451/41, 56, 287, 451/288, 290, 443, 444

(56) References Cited

U.S. PATENT DOCUMENTS 5,885,137 * 9/1999 Ploessl ..... 451/56
5,954,570 * 9/1999 Yano et al. ..... 451/285
6,001,008 * 12/1999 Fujimori et al. ..... 451/443

* cited by examiner

*Primary Examiner*—Joseph J. Hail, III
*Assistant Examiner*—Shantese McDonald
(74) *Attorney, Agent, or Firm*—George O. Saile; Rosemary L. S. Pike

(57) ABSTRACT

A polishing pad conditioner used in the removal of slurry and semiconductor thin film build-up in the polishing pad in a chemical and mechanical polishing (CMP) process used to planarize a semiconductor wafer surface. The conditioner is pressed against the polishing pad, often while de-ionized water is applied, to remove the material build-up. The conditioner of the present invention has a convex lower surface covered by diamond crystals that are bonded to the underside of the nickel alloy conditioner. Typically, the difference between the center and the edge of the conditioning surface will range from a minimum of about 0.2 mm (very slightly convex) to a maximum of the entire thickness of the conditioning surface (more convex). The convex shape reduces the friction between the pad and conditioner and allows the slurry to reach the center of the conditioner. This more uniformly conditions the pad surface which yields more uniformly polished wafers and also increases pad life. Brazing is used to form a molecular bond between the abrasive diamond crystals and the nickel alloy conditioner. This bond is not attacked by the low pH slurry used in CMP, eliminating the problem where diamond crystals separate from the conditioner causing scratches on the wafer surface.

21 Claims, 2 Drawing Sheets

ROUNDED SURFACE FOR THE PAD CONDITIONER USING HIGH TEMPERATURE BRAZING

BACKGROUND OF THE INVENTION (1) Field of the Invention

The invention generally relates to a chemical mechanical polishing process used in semiconductor manufacturing and, more particularly, to a pad conditioner used to remove build up of residue and slurry from an abrasive polishing pad during a chemical and mechanical polishing process of a semiconductor wafer.

(2) Description of Prior Art

Semiconductor fabrication often uses a combination of chemical and mechanical polishing (CMP) to reduce the thickness and planarize a thin film coating on a wafer. Typically, the wafer is placed in a polishing head and makes contact with a rotating polishing pad having a slurry applied thereto. Often the polishing head holding the wafer also rotates making the planarization process more uniform.

FIGS. 1*a* and 1*b* illustrate schematically the current art for the CMP process. FIG. 1*a* shows a cross section of the CMP process, while FIG. 1*b* shows a more simplified top view. The wafer (not shown) is contained laterally by a wafer carrier 106. To facilitate thin film planarization, uniform pressure is applied mechanically from above to the carrier 106 holding the wafer firmly against the polishing pad 100. The polishing table 102 and polishing pad 100 are rotated at a set speed about axis A2 by adjusting the polishing table drive mechanism 104. The carrier drive mechanism 108 will rotate the wafer carrier 106 about axis A1 at a second predetermined speed. During the CMP process an abrasive and chemical slurry 116 is dispensed through a spigot 110. During the polishing operation residue from the wafer and particles in the slurry 116 build up in pores of the pad 100. Over time this reduces the thin film removal rate and can result in yield loss. For this reason, the pad is periodically conditioned. The conditioner 112 typically having a diamond abrasive crystal electroplated to the lower surface (not shown) is pressed against the pad 100 while being moved radially across the pad 100 and rotated about axis A3 by the conditioner drive mechanism 114. This conditioning operation can be performed while a wafer is being polished, but often is performed as a separate step with de-ionized (DI) water applied to the pad. The conditioning process is only performed when needed because constant contact of the conditioner 112 and pad 100 would cause the pad 100 to wear out prematurely.

Referring now to FIG. 2 illustrating in cross section the current art for pad conditioning. Here a conditioner 112 having a flat, diamond abrasive crystal lower surface 118 is pressed against the pad 100. The diamond crystals 118 are usually electroplated to a nickel alloy conditioner 112. Unfortunately, this arrangement causes the conditioning to occur non-uniformly which in turn results in non-uniform material removal from the wafer. The non-uniform conditioning is caused by two factors. The first factor is due to the increased friction at the leading (left) edge of the conditioner 112. This additional friction results from the relative motion between the pad 100 and conditioner 112. The second factor is that, due to the shape of the conditioner 112, the slurry (not shown) used during the conditioning process (typically DI water) will not reach the center of the conditioner 112. One other problem with this pad conditioning method is that the low pH slurry attacks the diamond crystals 118 causing particles to fall off and subsequently scratch the wafers.

Other approaches attempt to address problems with pad conditioning and maintaining polishing uniformity. U.S. Pat. No. 5,605,499 to Sugiyama et al. teaches a method using a specific polishing pad along with an oscillating conditioning tool which has a shape designed to conform to the shape of the backing film used on the wafer carrier. U.S. Pat. No. 5,667,433 to Mallon teaches a method using keys to locking the conditioner in place thereby eliminating slippage of the conditioner. U.S. Pat. No. 5,823,854 to Chen teaches a method utilizing an automated measuring process to determine when the polishing pad needs conditioning. U.S. Pat. No. 5,904,615 to Jeong et al teaches a method using a disc or cup shaped conditioner while providing ultrasonic vibration to the conditioner. U.S. Pat. No. 5,906,754 to Appel et al teaches a method where polishing and conditioning are performed simultaneously. There are three embodiments of this invention using conditioners with a lower surface having triangular teeth, rectangular teeth and dimples, respectively.

SUMMARY OF THE INVENTION

A principal object of the present invention is to provide a CMP process which polishes the wafer equally across the wafer surface by circumventing the problems caused by non-uniform pad conditioning. In doing this, material removal at the edge of the wafer will be equal to that at the center resulting in even planarization of thin film semiconductor material.

Another object of the present invention is to provide an improved mechanism for uniform conditioning of the polishing pad used in CMP.

Another object of the present invention is to extend the life of the polishing pad used during the polishing process.

Yet another object of the present invention is the reduction in friction between the leading edge of the conditioner and the polishing pad.

A further object of the present invention is equal distribution of slurry under the conditioning surface of the conditioner.

Another object of the present invention is to provide an improved method of bonding the diamond crystals to the lower surface of the polishing pad.

A still further object of the present invention is to provide an improved method for uniform conditioning of the polishing pad used in CMP by using a conditioner with a convex lower surface.

These objects are achieved by using a conditioner with a convex lower surface covered by diamond crystal abrasive surface. The modification in shape reduces the friction between the pad and conditioner and also allows the slurry to reach the center of the conditioner. This results in a more uniformly conditioned surface which then yields more uniformly polished wafers.

BRIEF DESCRIPTION OF THE DRAWINGS

In the accompanying drawings forming a material part of this description, there is shown:

FIG. 1*a* shows a cross section of the CMP apparatus, while FIG. 1*b* shows a top view of the CMP apparatus.

DESCRIPTION OF THE PREFERRED EMBODIMENTS

Figure 1A:
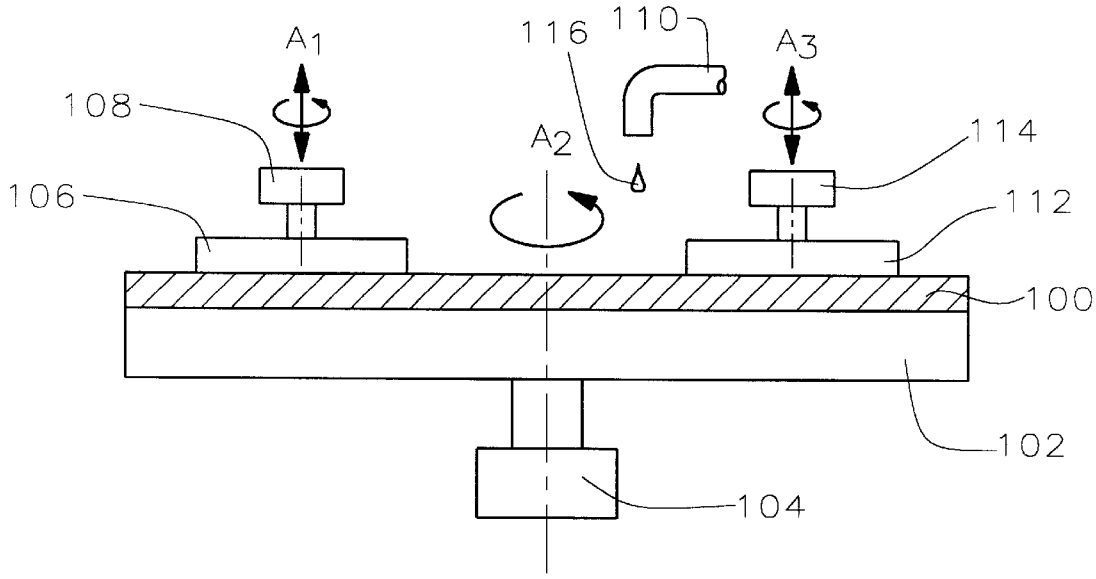
FIG. 1A Prior Art
FIGS. 1*a* and 1*b* illustrate a schematic representation of the current art in CMP including the conditioner.
Figure 1B:
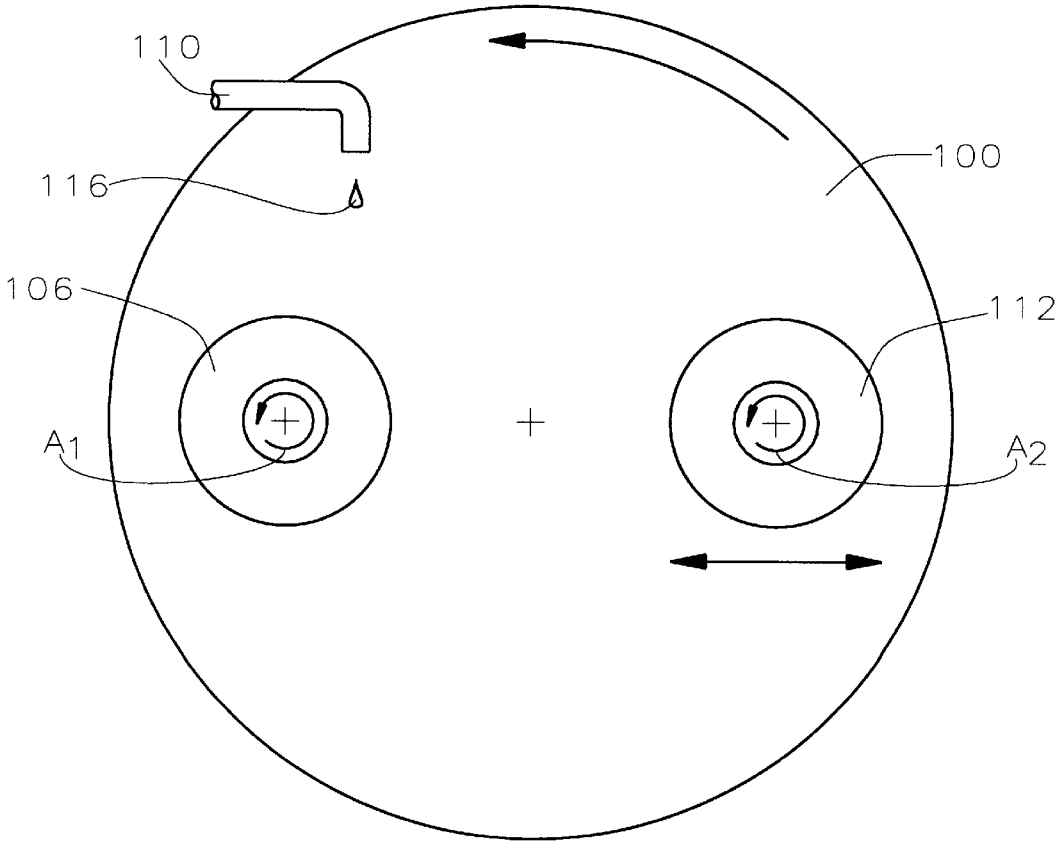
FIG. 1B Prior Art
Figure 2:
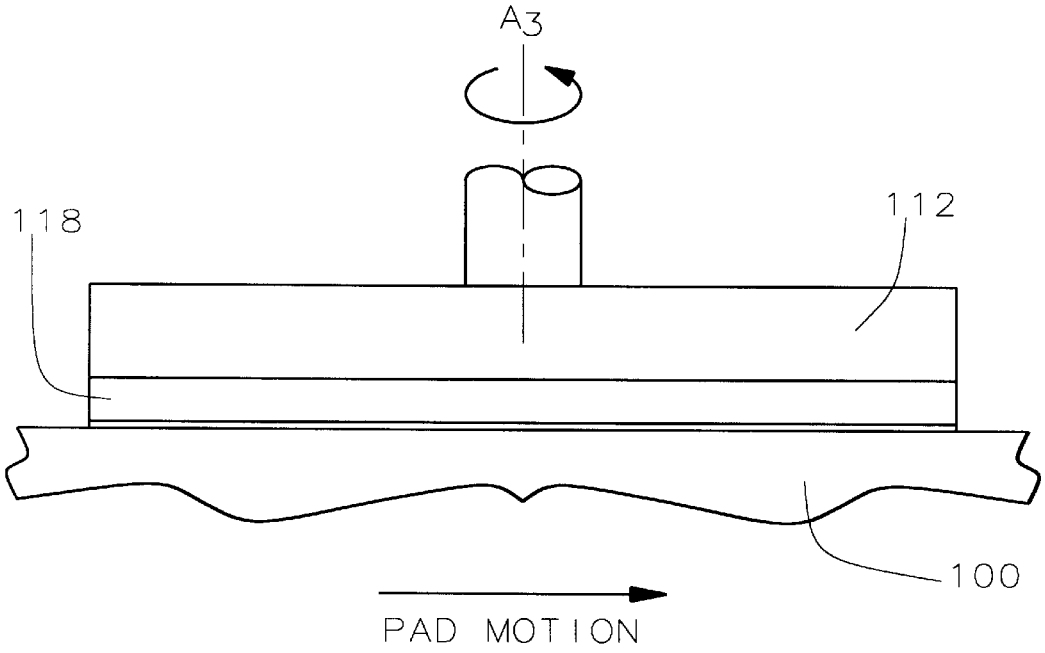
FIG. 2 Prior Art
FIG. 2 illustrates the pad and conditioner of the prior art and shows the relative motion between them.
Figure 3:
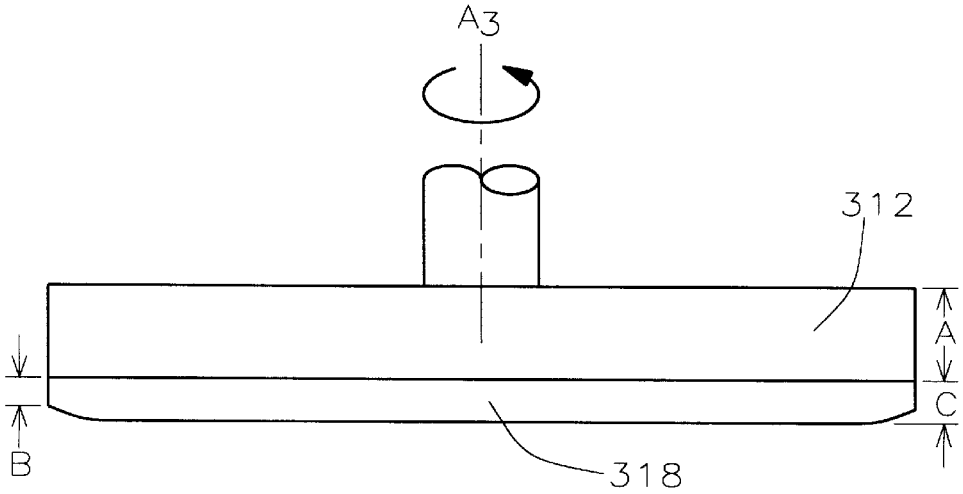
FIG. 3 shows in cross-section the conditioner of the present invention illustrating the convexity of the conditioning surface.

Referring now more particularly to FIG. 3, there is shown the conditioner 312 with conditioning surface 318 of the present invention. This figure illustrates the convexity of the conditioning surface. Typically the conditioner 312 has a thickness (dimension A) of between about 10 to 25 mm. The thickness of the conditioning surface 318 at the center (dimension C) is between about 0.5 to 5 mm. The thickness of the conditioning surface 318 at the edges (dimension B) is between about 0 and 4.8 mm. This allows the thickness difference between the center and the edge of the conditioning surface to measure a minimum of about 0.2 mm (very slightly convex) to a maximum of the entire thickness of the conditioning surface (more convex). The conditioning surface 318 is typically a diamond abrasive crystal grit. Molecular bonding using high temperature annealing (brazing) is used to attach the diamond crystal to the nickel alloy conditioner 312. This bonding method will not be susceptible to attack by the low pH slurry.

Using a convex shaped pad conditioner, the present invention circumvents the problems created by non-uniform pad conditioning thus providing a CMP process which polishes the wafer equally across the wafer thereby resulting in even planarization of thin film semiconductor material. In addition, the use of the convex pad conditioner extends the life of the polishing pad used during the polishing process and reduces the friction between the leading edge of the conditioner and the polishing pad. The present invention results in equal distribution of slurry under the conditioning surface of the conditioner and provides more uniform conditioning of the polishing pad used in CMP. Finally, brazing the diamond crystals to the underside of the nickel alloy conditioner forms a molecular bond between the crystals and conditioner that is not attacked by the low pH slurry used in CMP. This eliminates the problem where diamond crystals separate from the conditioner causing scratches on the wafer surface.

While the invention has been particularly shown and described with reference to the preferred embodiments thereof, it will be understood by those skilled in the art that various changes in form and details may be made without departing from the spirit and scope of the invention.

What is claimed is:

1. A polishing pad conditioner for removing the buildup of slurry and semiconductor film from said polishing pad produced during chemical mechanical polishing comprising a conditioner having its entire lower surface which is convex in shape.

2. The pad conditioner according to claim 1 wherein said lower conditioning surface has a center thickness of no more than about 5 mm.

3. The pad conditioner according to claim 1 wherein said lower conditioning surface has a thickness at the edges of no more than about 4.8 mm.

4. The pad conditioner according to claim 1 wherein said lower conditioning surface has a difference in thickness between the edges and center of at least 0.2 mm.

5. The pad conditioner according to claim 1 wherein said lower conditioning surface is comprised of diamond grit molecularly bonded to a nickel alloy by high temperature brazing.

6. The pad conditioner according to claim 1 wherein said conditioner rotates and moves radially on said polishing pad.

7. The pad conditioner according to claim 1 whereby de-ionized water is applied to said pad during said pad conditioning process.

8. A polishing pad conditioner for removing the buildup of slurry and semiconductor film from said polishing pad produced during chemical mechanical polishing comprising a conditioner having its entire lower surface which is convex in shape with a center thickness of no more than about 5 mm and an edge thickness of no more than about 4.8 mm.

9. The pad conditioner according to claim 8 wherein said lower conditioning surface is comprised of diamond grit molecularly bonded to a nickel alloy by high temperature brazing.

10. The pad conditioner according to claim 8 wherein said conditioner rotates and moves radially on the polishing pad.

11. The pad conditioner according to claim 8 whereby de-ionized water is applied to said pad during the pad conditioning process.

12. A polishing pad conditioner for removing the buildup of slurry and semiconductor film from the polishing pad produced during chemical mechanical polishing comprising a conditioner having its entire lower surface which is convex in shape and is composed of a diamond grit molecularly bonded to a nickel alloy by high temperature brazing with a center thickness of no more than about 5 mm and an edge thickness of no more than about 4.8 mm.

13. The pad conditioner according to claim 12 wherein said conditioner rotates and moves radially on said polishing pad.

14. The pad conditioner according to claim 12 whereby de-ionized water is applied to said pad during the pad conditioning process.

15. A polishing pad conditioner for removing the buildup of slurry and semiconductor film from the polishing pad produced during chemical mechanical polishing comprising a conditioner having its entire lower surface which is convex in shape having a difference in thickness between the edges and center of at least 0.2 mm.

16. The pad conditioner according to claim 15 wherein said lower conditioning surface is comprised of diamond grit molecularly bonded to a nickel alloy by high temperature brazing.

17. The pad conditioner according to claim 15 wherein said conditioner rotates and moves radially on said polishing pad.

18. The pad conditioner according to claim 15 whereby de-ionized water is applied to said pad during the pad conditioning process.

19. A polishing pad conditioner for removing the buildup of slurry and semiconductor film from the polishing pad produced during chemical mechanical polishing comprising a conditioner having a lower conditioning surface which is convex in shape and is composed of a diamond grit molecularly bonded to a nickel alloy by high temperature brazing having a difference in thickness between the edges and center of at least 0.2 mm.

20. The pad conditioner according to claim 19 wherein said conditioner rotates and moves radially on said polishing pad.

21. The pad conditioner according to claim 19 whereby de-ionized water is applied to said pad during the pad conditioning process.

* * * * *